US006499896B1

(12) United States Patent
Sickler

(10) Patent No.: US 6,499,896 B1
(45) Date of Patent: Dec. 31, 2002

(54) FREEHAND WRITING INSTRUMENT

(76) Inventor: Lori Sickler, 196 Locust Dr., Union, NJ (US) 07083

( * ) Notice: Subject to any disclaimer, the term of this patent is extended or adjusted under 35 U.S.C. 154(b) by 0 days.

(21) Appl. No.: 10/052,618

(22) Filed: Jan. 23, 2002

(51) Int. Cl.[7] ..... B43K 23/00; B43L 9/00; B43L 11/00

(52) U.S. Cl. ..... 401/48; 15/437; 33/18.2; 401/52; 401/88; 401/195

(58) Field of Search ..... 401/48, 143, 52, 401/99, 88, 195; 15/437, 435; 33/182

(56) References Cited

U.S. PATENT DOCUMENTS 3,390,460 A * 7/1968 Brown et al. ..... 401/195 X
3,997,972 A * 12/1976 Jaunarajs ..... 401/52 X
5,685,224 A * 11/1997 Dean et al. ..... 401/208 X

* cited by examiner

*Primary Examiner*—David J. Walczak
*Assistant Examiner*—Kathleen J. Prunner
(74) *Attorney, Agent, or Firm*—Thomas L. Adams

(57) ABSTRACT

A freehand writing instrument will hold a writing tip. The instrument can draw the writing tip across a writing surface in one or more strokes. The instrument has a case sized to be handheld and has a longitudinal axis extending between a distal and proximal end of the case. Also included is a motor mounted at the case. The writing instrument also has an arm mounted at the proximal end of the case. The arm is driven by the motor to move periodically about a predetermined center, reaching a maximum transverse displacement from the center. With the distal end of the case defined as a vertex, this maximum transverse displacement is sized to subtend a displacement angle with respect to the longitudinal axis. The arm has a holder adapted to transversely hold the writing tip at an orientation displaced from parallel to the longitudinal axis no more than the displacement angle. The arm can produce a periodic pattern on the writing surface during the strokes. The arm has clearance to permit the writing tip to write with the case held at varying angles of inclination within a range of angles relative to the writing surface. This angle of inclination is adjustable to alter the periodic pattern.

13 Claims, 2 Drawing Sheets

FIG. 3A
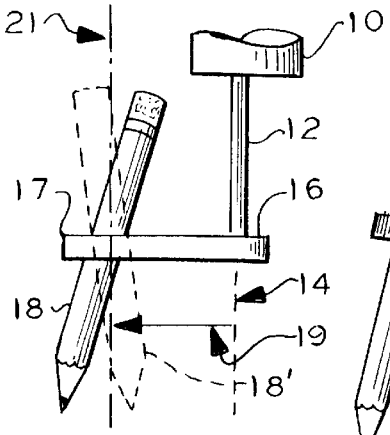
FIG. 3C
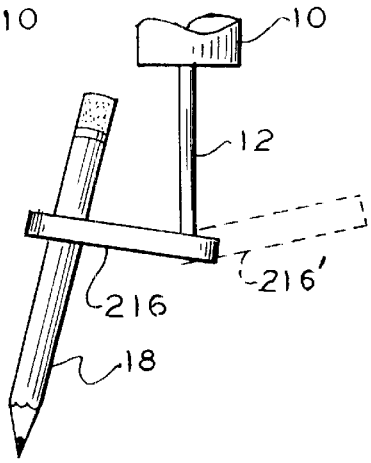
FIG. 3D
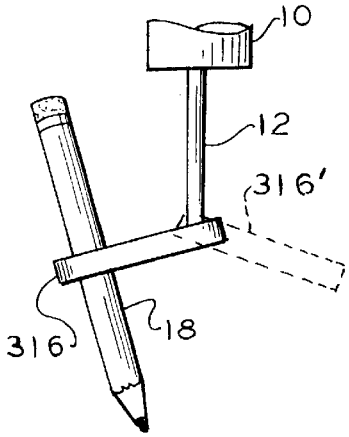
FIG. 6
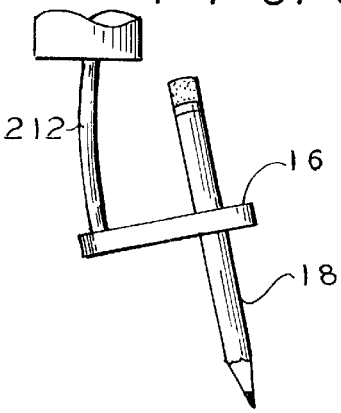
FIG. 7
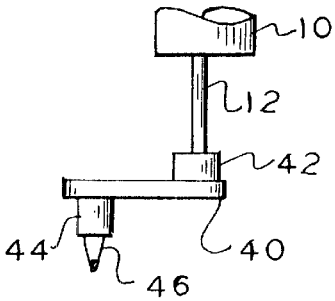
FIG. 3B
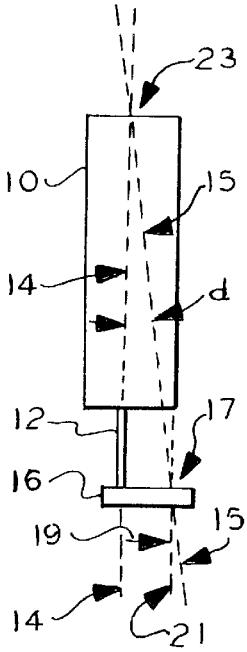
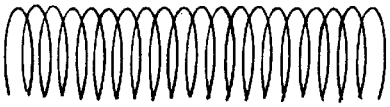
FIG. 8A
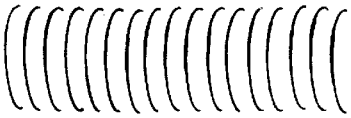
FIG. 8B
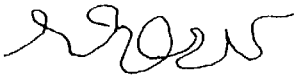
FIG. 8C

FREEHAND WRITING INSTRUMENT

BACKGROUND OF THE INVENTION

1. Field of the Invention

The present invention relates to freehand writing instruments, and in particular, to instruments that are motorized to alter the writing.

2. Description of Related Art

For a freehand writing instrument to maintain a comfortable feel, the angular orientation of the writing tip should be parallel or close to parallel to the centerline or longitudinal axis of the instrument. The tolerable amount of angular displacement from parallel depends on whether the writing tip lies on the centerline (longitudinal axis) of the writing instrument, or whether the writing tip is offset from this centerline (asymmetrical placement). For an asymmetrically placed writing tip, greater angular displacement of the writing tip is tolerable since the asymmetrical offset itself creates an inherent angular offset that can be compensated somewhat by tilting the writing tip. The tolerable angular displacement of the writing tip is a function of the inherent angle between the centerline (longitudinal axis) of the writing instrument and a line originating on the instrument's centerline at the upper (distal) end of the writing instrument and running to the lower (proximal) end of the instrument, terminating at a distance from the centerline representing the asymmetrical offset of the writing tip from this centerline. In effect, asymmetrical writing instruments having a greater asymmetrical offset can tolerate a writing tip with a greater tilting from an orientation parallel to this centerline (longitudinal axis) of the writing instrument.

Writing instruments have been designed to alter the appearance of a writer's normal strokes. Such devices have been designed purely for entertainment or to produce special effects needed for specialized drawings.

In U.S. Pat. No. 3,997,972 a writing instrument 17 is connected to a spinning shaft 11*a* by a flexible coupler 18. In the examples of FIGS. 2 and 3, special effects are produced by pressing the spinning tip of the writing instrument 17 so it rolls or "walks" back and forth across the writing surface (parallel strokes of FIGS. 7 and 12). Alternatively, the writing instrument can be held upright as shown in FIG. 4 so that the tip of the writing instrument can roll along a somewhat erratic spiral path, as shown in FIGS. 8–11. In any event, the speed of the writing tip is disadvantageously determined by the rolling properties of the tip. Also, "walking" the spinning writing tip in this way quickly wears the tip.

For the embodiments of FIGS. 5 and 6 of U.S. Pat. No. 3,997,972, the writing tip follows a conical orbit, staying essentially aligned as a conical ray (subject to some skewing due to flexing of coupler 18). (FIG. 6 may be deemed a cone with a zero conical angle.) When the barrel is tilted in a natural way as shown, the writing pressure varies orbitally. A problem with this design is that the angle of the writing tip 17 is quite different from the angle of the barrel 10. Consequently, the feel of the writing tip is changed by the canting of the tip 17 relative to the barrel 10. If however, the angle between the writing tip 17 and barrel 10 were to be kept small, the amplitude of oscillations of the tip will remain too small.

In U.S. Pat. No. 5,752,870 a toy moves along a surface to drive a wheel, while pens are thereby rotated to draw a pattern on the surface. The pens are held in a turret 57 (FIG. 6) and rotate about a shaft 51. This arrangement requires the wheels and other rollers to remain on the writing surface, so that the assembly maintains a constant parallel orientation to the writing surface. Thus, this device cannot be used like a simple freehand writing instrument. This apparatus lacks a free expressive quality, and must be moved about with a limited motion, much like a scrub brush. See also U.S. Pat. No. 3,638,319 for a wheel-driven toy where the writing instruments are held on the toy, but not mechanically rotated.

In U.S. Pat. No. 4,835,874 a marking device attached to a ring gear can orbit inside a handheld device as it slides across a drawing surface. This assembly must remain flat on the writing surface and is pushed around that surface with a scrubbing motion. Thus, this reference does not allow the expressive strokes possible with a freehand writing instrument.

In U.S. Pat. Nos. 3,390,460; 5,208,987; and 5,433,642 an eccentric weight is spun in the upper end of a writing instrument to cause oscillations about the writer's fingers. These spinning mechanisms must generate substantial force to overcome the writer's grip. Consequently, a substantial mass must be placed at the end of the writing instrument, which will tend to produce an off-balanced feel. Also, since the vibrations must necessarily be transferred through the writer's fingertips, this device will quickly become uncomfortable and have a tendency to numb the writer's fingertips.

SUMMARY OF THE INVENTION

In accordance with the illustrative embodiments demonstrating features and advantages of the present invention, there is provided a freehand writing instrument for holding a writing tip. The instrument is operable to draw the writing tip across a writing surface in one or more strokes. The instrument has a case sized to be handheld and has a longitudinal axis extending between a distal and proximal end of the case. Also included is a motor mounted at the case. The writing instrument also has an element mounted at the proximal end of the case. The element is driven by the motor to move periodically about a predetermined center reaching a maximum transverse displacement from the center. With the distal end of the case defined as a vertex, this maximum transverse displacement is sized to subtend a displacement angle with respect to the longitudinal axis. The element has a holder adapted to transversely hold the writing tip at an orientation displaced from parallel to the longitudinal axis no more than the displacement angle. The element is operable to produce a periodic pattern on the writing surface during the strokes. The element has clearance to permit the writing tip to write with the case held at varying angles of inclination within a range of angles relative to the writing surface. The angle of inclination is adjustable to alter the periodic pattern.

By employing apparatus of the foregoing type, an improved writing instrument is achieved. In a preferred embodiment a cylindrical case contains a battery and a motor driven by the battery. A motor-driven shaft extending from the case supports a claw-like arm that is connected, preferably, at right angles to the motor shaft. A pen, pencil or other writing tip can be held in the arm substantially parallel to the shaft and the longitudinal axis of the case. This orientation gives the writing instrument an overall proper feel.

By pressing a pushbutton on the case the motor can spin the arm, preferably, in a plane perpendicular to the motor shaft. Depending upon the angle of inclination of the writing instrument, the writing tip can write connected loops or successive disconnected marks. In some embodiments the writing tip may be allowed to wobble slightly in which case the writing pattern can be more complex and somewhat chaotic or random.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIGS. 3A–3D are elevational views of the holder arm of FIG. 1 shown normally and with various angular adjustments;

FIGS. 5–7 are elevational views of a holder arm that is an alternate to that shown in FIG. 1;

FIGS. 8A–8C are plan views of various writings produced by the instrument of FIG. 1, which writings vary depending upon the handling of the writing instrument and the nature of the writing hardware.

DETAILED DESCRIPTION OF THE PREFERRED EMBODIMENTS

Figure 1:
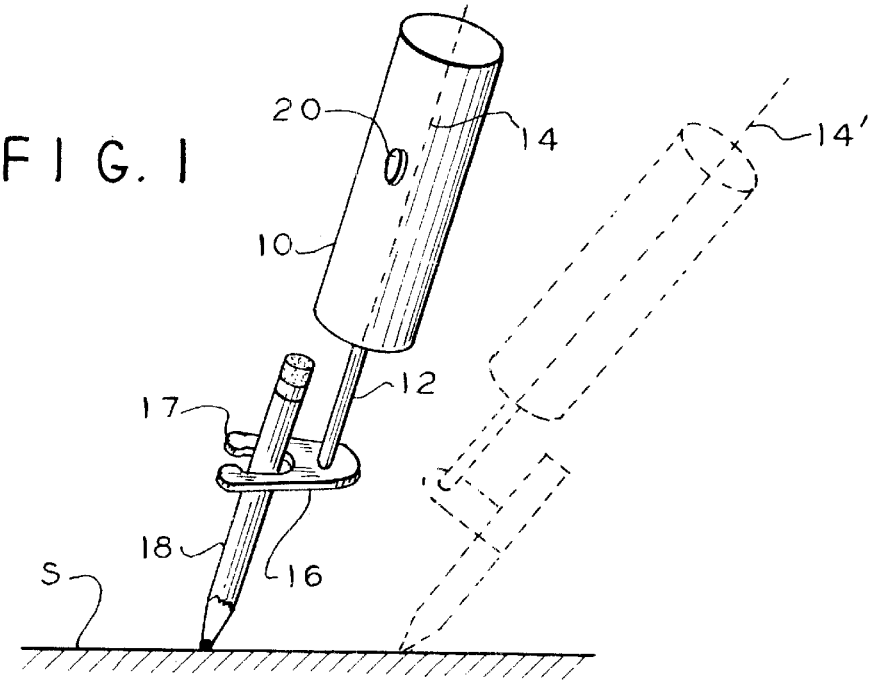
FIG. 1 is a perspective view of a freehand writing instrument in accordance with principles of the present invention, including an angularly displaced view of the instrument shown in phantom.

Referring to FIG. 1, a freehand writing instrument is shown as a case 10 with a motor shaft 12 extending from the case along longitudinal axis 14 (axis 14 is also referred to as a centerline or central axis). An element 16 is shown as an arm attached to the distal end of motor shaft 12. Arm 16 has a forked distal end 17 acting as a holder or receptacle for holding pencil 18 (pencil 18 and other writing devices are generally referred to as a writing tip).

The illustrated writing instrument is a freehand instrument in that the device is supported by the writer's hand and the angle of inclination of longitudinal axis 14 can be freely changed, as illustrated by the phantom view of the instrument, which is shown tilted along axis 14'.

As explained further hereinafter, shaft 12 is spun by a motor (illustrated hereinafter) inside case 10. This motor is activated by depressing pushbutton 20. For the embodiment of FIG. 1, the arm will rotate along a plane perpendicular to the longitudinal axis 14.

Figure 2:
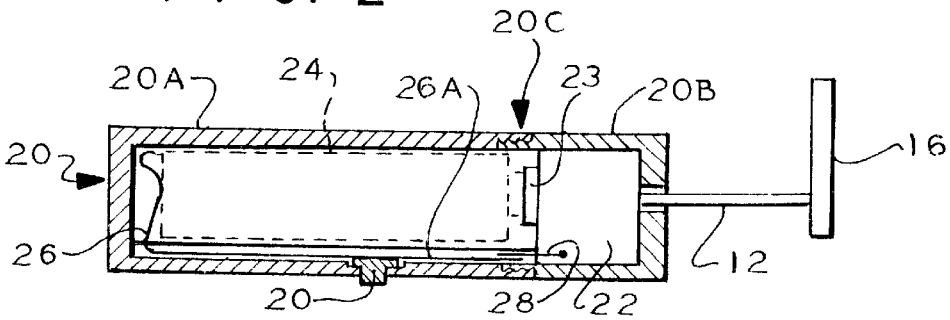
FIG. 2 is a side view, partially in section, of the instrument of FIG. 1.

Referring to FIG. 2, case 20 is shown composed of two cylindrical halves 20A and 20B, which are screwed together at threaded joint 20C. Motor 22 is shown installed in the casing half 20B. Motor 22 drives motor shaft 12 to spin arm 16. Battery 24 is shown installed in casing half 20A. The end of battery 24 adjacent to motor 22 connects to the motor's battery contact 23. The motor's other contact 28 is normally open and is adjacent to leg 26A of spring contact 26, which connects to the far end of battery 24. Leg 26A can be pressed against motor contact 28 by depressing push button 20 in order to start motor 22.

Referring to FIGS. 3A and 3B, previously mentioned arm 16 is shown with pencil 18 installed in the arm's forked holder 17. It will be appreciated that instead of a pencil, a pen, a marker or any other type of writing tip can be placed in the forked end of arm 16. While writing tip 18 may be held perpendicularly to arm 16, this view illustrates how writing tip 18 can be swung to either side of perpendicular. In general, writing tip 18 can fall within a solid or conical angle centered on axis 21, which is parallel to longitudinal axis 14. A diverging tip position is shown in full, while a converging position 18' is shown in phantom.

The holder of arm 16 can either hold writing tip 18 at a fixed angle or can hold the tip loosely, allowing the angle of tip 18 to wobble and change in response to writing pressure and kinematics. In any event, the writing tip will be held within a predetermined acute angle relative to the longitudinal axis (axis 14 of FIG. 1). Consequently, arm 16 will be held at an angle in excess of this predetermined acute angle.

Referring to FIG. 3B, holder 17 of arm 16 follows a circular path, although other paths may be followed in different embodiments. In these embodiments the holder end 17 of arm 16 will move periodically about a predetermined center (in the illustrated embodiment this center lies on the longitudinal axis 14). The maximum transverse displacement is shown herein as the radial distance 19 from the longitudinal axis 14 to the center line 21 of the holder 17. For non-circular paths such as an elliptical path, the maximum transverse displacement will be the distance from the center of the ellipse along its major axis. For other paths that may not have mathematically defined centers, the center may be deemed to be a predetermined point at a central location within or adjacent to the borders of the path.

A displacement angle d is defined herein by axis 15 relative to the longitudinal axis 14, with the vertex of the angle being defined as the distal end 23 of case 10 at the longitudinal axis 14. Axis 15 extends between vertex 23 to the holder end 17 of arm 16 (that is, at the intersection between center line 21 and arm 16).

Referring again to FIG. 3A, writing tip 18 may be displaced somewhat from an orientation parallel to the longitudinal axis 14. It is desirable to keep writing tip 18 parallel or close to parallel to axis 14, taking into account the magnitude of the transverse displacement 19. For arms 16 offering a relatively large transverse displacement 19, the angular displacement of writing tip 18 can be somewhat larger. In particular, it is desirable to limit the angular displacement of writing tip 18 relative to center line 21 (line 21 is parallel to longitudinal axis 14). Specifically, this angular displacement relative to center line 21 ought to be no more than previously mentioned displacement angle d (FIG. 3B).

Referring to FIG. 3C, previously mentioned motor shaft 12 is shown fitted with an arm 216 that is identical to the previously illustrated arm (arm 16), except that arm 216 has an elevated distal end so that the arm will trace out a conical path (apex down). The diametrically opposite position of arm 216 is shown in phantom as arm 216'.

Referring to FIG. 3D, motor shaft 12 is shown fitted with an arm 316 that is identical to the previously illustrated arm (arm 16), except that arm 316 has an lowered distal end so that the arm will trace out a conical path (apex up). The diametrically opposite position of arm 316 is shown in phantom as arm 316'. It will be appreciated that the writing tips installed in the arms of FIGS. 3B and 3C can be tilted in a fashion similar to that shown in FIG. 3A.

Figure 4:
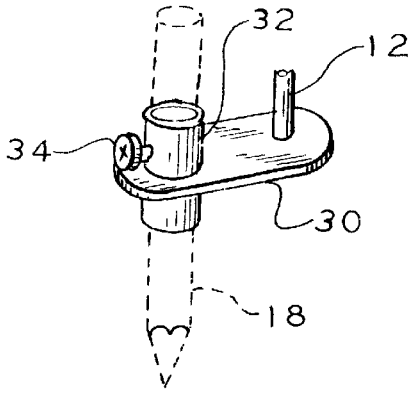
FIG. 4 is a perspective view of a holder arm that is an alternate to that shown in FIG. 1.

Referring to FIG. 4, previously mentioned motor shaft 12 is fitted with an alternate arm 30. A holder at the distal end of arm 30 is shown as a cylindrical sleeve 32 extending above and below arm 30. A writing tip 18 (shown in phantom) may be secured in sleeve 32 by means of set screw 34. In this embodiment writing tip is rigidly held parallel to shaft 12.

Figure 5:
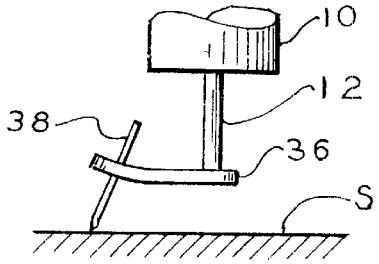

Referring to FIG. 5, previously mentioned motor shaft 12 is shown fitted with alternate arm 36. The distal end of arm 36 has a holder for holding writing tip 38. Tip 38 may be a pencil lead, a marker tip, or any other type of writing device. Tip 38 may be secured in a hole or in a gripping fork (not shown). In some embodiments, tip 38 may be permanently embedded in arm 36 at the time of manufacture. In such cases, arm 36 and tip 38 may be removed, discarded, and replaced when the tip 38 is depleted.

Arm 36 is elastomeric and is shown deflecting in response to downward pressure applied by a writer through case 10. In other embodiments arm 36 will be more rigid and will not flex as illustrated. In still other embodiments arm 36 may be relatively rigid and may have the illustrated crooked profile in order to produce specific writing effects.

Referring to FIG. 6, previously mentioned arm 16 is shown attached to an alternate shaft 212. Shaft 212 is flexible and is shown deflecting in response to downward pressure applied by a writer. In other embodiments shaft 212 may be relatively rigid and may have the illustrated crooked profile in order to produce specific writing effects.

Referring to FIG. 7, previously mentioned motor shaft 12 is shown attached to the hub 42 of alternate arm 40. A holder at the distal end of arm 40 supports a stub 44 containing an ink reservoir. A ball point writing tip 46 is shown attached to the distal end of stub 44.

To facilitate an understanding of the principles associated with the foregoing apparatus, the operation of the embodiment of FIGS. 1 and 2 will be briefly described first. The embodiments of FIGS. 4 and 7 will operate similarly, but will employ different hardware to produce similar effects.

A writer can install pencil 18 in the jaws of forked holder 17. The tines of holder 17 have a limited amount of flexibility and can tightly grip pencil 18. Instead of a pencil 18, a writer may install a pen, a felt marker, or other writing tip.

The writer may hold the writing instrument by gripping case 10 and simultaneously depressing pushbutton 20 while pressing the point of pencil 18 against writing surface S. Leg 26A will be pressed against contact 28 so that motor 22 will be powered by battery 24. In response, motor shaft 12 will rotate arm 16 to orbit holder 17 and pencil 18. Preferably, arm 16 will rotate about 200 rpm, although in other embodiments arm 16 may rotate between 30 to 400 rpm. The specific speed may be selected depending on the writer's preference, the effect desired, the tolerable vibration, etc. In some embodiments the angular speed of motor 22 can be altered by employing a gear reducer (not shown) to reduce the speed and increase the torque of motor shaft 12.

For the relatively steep angle of inclination shown in full in FIG. 1 (longitudinal axis 14), the point of pencil 18 will remain on writing surface S. In this embodiment contact with the writing surface S is enhanced by making arm 16 of a flexible plastic that can deflect as the arm rotates. Also the pencil 18 is allowed to wobble slightly in forked holder 17.

For embodiments where it is desirable for the tip of pencil 18 to break contact with writing surface S, arm 16 can be relatively rigid and can hold pencil 18 rigidly to prevent wobbling. Also, the angular speed of shaft 12 can be increased to prevent axial oscillation of case 10 that might otherwise increase the percentage of time that the tip of pencil 18 remains in contact with writing surface S.

When the tip of pencil 18 remains in contact with writing surface S as the writing instrument is moved across the surface S, a continuous loop is drawn as shown in FIG. 8A.

The writer can change the pattern produced by the writing instrument without changing the motor speed or the hardware of the writing instrument. For example, the writer may press harder to keep the tip of pencil 18 in contact with writing surface S for a greater percentage of time, or vice versa. Also, the writer may reduce the contact with writing surface S by changing the angle of inclination to that shown in phantom in FIG. 1 (inclination along axis 14'). At this shallower angle, the elevation of the distal end of arm 16 will change more dramatically during each revolution of shaft 12. Consequently, the writing instrument will produce a number of interrupted lines as shown in FIG. 8B.

For embodiments where arm 16 is flexible and pencil 18 is allowed to wobble somewhat in holder 17, the angular orientation of pencil 18 can vary dramatically with the angle of inclination of axis 14, the downward pressure of the writer, the phase of arm 16, etc. In such a dynamic system the motion of pencil 18 will be chaotic. Accordingly, the pattern produced by pencil 18 can appear random, as shown in FIG. 8C.

For the embodiments of FIGS. 3C and 3D arms 216 and 316 can form an acute or obtuse angle, respectively, with shaft 12. In these embodiments writing tip 18 and shaft 12 remain in the same plane, although in other embodiments the writing tip can be skewed from such a common plane. For the embodiment of FIG. 3C the upper end of pencil 18 points toward the distal end of case 10 while the lower end of pencil 18 converges outwardly to produce a more exaggerated writing. For the embodiment of FIG. 3D the lower end of pencil 18 points inwardly to create a more compact and intricate pattern.

For the embodiments of FIGS. 5 and 6, downward pressure by the writer flexes arm 36 (FIG. 5) or shaft 212 (FIG. 6). Thus, the writer can change the angle of divergence of the writing tip by modulating downward pressure.

It is appreciated that various modifications may be implemented with respect to the above described, preferred embodiments. The illustrated case can be shape differently and may be produced indifferent proportions depending upon the desired weight, gripping style, writer preference, writing application, etc. The illustrated arms and motor shafts can be sized and portioned differently depending on the desired strength, speed, holding power, etc. Some embodiments may employ a pair of spaced arms to reduce any tendency of the writing tip to wobble. Instead of a rotating arm, some embodiments may provide a reciprocating element that can follow and retrace a predetermined path. In such cases the motion may be produced by cranks, levers, etc. Instead of a rotary motor, some embodiments may incorporate a solenoid that is periodically actuated to provide a reciprocating linear movement. In still other embodiments the upper end of a writing tip may be held in a ball joint while the lower portion of the writing tip is subjected to periodic motion.

Obviously, many modifications and variations of the present invention are possible in light of the above teachings. It is therefore to be understood that within the scope of the appended claims, the invention may be practiced otherwise than as specifically described.

What is claimed is:

1. A freehand writing instrument for holding a writing tip, said instrument being operable to draw said writing tip across a writing surface in one or more strokes, the instrument comprising:

a case sized to be handheld and having a longitudinal axis extending between a distal and proximal end of said case;

a motor mounted at said case; and an element mounted at the proximal end of said case and being driven by said motor to move periodically about a predetermined center reaching a maximum transverse displacement from said center, with said distal end of said case defined as a vertex said maximum transverse displacement being sized to subtend a displacement angle with respect to said longitudinal axis, said element having a holder adapted to transversely hold the writing tip at an orientation displaced from parallel to said longitudinal axis no more than said displacement angle, said element being operable to produce a periodic pattern on the writing surface during the strokes, said element having clearance to permit said writing tip to write with said case held at varying angles of inclination within a range of angles relative to said writing surface, the angle of inclination being adjustable to alter the periodic pattern.

2. A freehand writing instrument according to claim 1 wherein said element is adapted to hold said writing tip parallel to within a predetermined acute angle relative to said longitudinal axis, said element extending away from said longitudinal axis at an angle in excess of said predetermined acute angle.

3. A freehand writing instrument according to claim 2 wherein said motor is operable to cause said holder to orbit about said longitudinal axis.

4. A freehand writing instrument according to claim 3 wherein said holder is operable to keep said writing tip pointing in a direction substantially parallel to said longitudinal axis.

5. A freehand writing instrument according to claim 3 wherein said motor is operable to rotate said element along a plane perpendicular to said longitudinal axis.

6. A freehand writing instrument according to claim 3 wherein said motor is operable to rotate said element around said longitudinal axis along a plane perpendicular to said longitudinal axis.

7. A freehand writing instrument according to claim 1 wherein said holder is adapted to hold either a pencil or pen to provide the writing tip.

8. A freehand writing instrument according to claim 1 wherein said holder is forked and sized to hold either a pencil or pen to provide the writing tip.

9. A freehand writing instrument according to claim 1 wherein said motor is mounted within said case.

10. A freehand writing instrument according to claim 9 wherein said motor has a rotating shaft longitudinally aligned in said case.

11. A freehand writing instrument according to claim 10 comprising:

a battery mounted in said case end to end with said motor.

12. A freehand writing instrument according to claim 1 wherein said holder comprises:

an outwardly extending element attached to said drive shaft and having a receptacle for holding the writing tip in a normal orientation, the element being operable to rotate around a central axis and keep the normal orientation of the receptacle pointing in a direction that remains substantially parallel to the central axis.

13. A freehand writing instrument according to claim 1 wherein said element is flexible to allow angular deflection of said writing tip in response to writing pressure.

* * * * *